United States Patent [19]

Sugimura et al.

[11] 4,115,103

[45] Sep. 19, 1978

[54] GERMICIDAL HERBICIDE FOR AGRICULTURE AND HORTICULTURE

[75] Inventors: Yukio Sugimura, Wakayama; Norioki Miyamoto, Sakura; Tetsuji Iwasaki, Wakayama; Kyozaburo Tachibana, Sakura; Tsuneyuki Takeno, Wakayama, all of Japan

[73] Assignee: Kao Soap Co., Ltd., Tokyo, Japan

[21] Appl. No.: 807,148

[22] Filed: Jun. 16, 1977

[30] Foreign Application Priority Data

Jun. 30, 1976 [JP] Japan ..... 51-77195
Jun. 30, 1976 [JP] Japan ..... 51-77196

[51] Int. Cl.[2] ..... A01N 9/12; A01N 9/14

[52] U.S. Cl. ..... 71/98; 71/103; 424/320

[58] Field of Search ..... 71/103, 98

[56] References Cited

U.S. PATENT DOCUMENTS

| | | | |
|---|---|---|---|
| 2,634,262 | 4/1953 | Fincke | 71/103 |
| 3,138,519 | 6/1964 | Riden et al. | 71/103 |
| 3,227,542 | 1/1966 | Kurtz et al. | 71/103 |

FOREIGN PATENT DOCUMENTS

| | | | |
|---|---|---|---|
| 82,372 | 1975 | Japan | 71/103 |
| 84,944 | 1975 | Japan | 71/103 |
| 84,975 | 1975 | Japan | 71/103 |

OTHER PUBLICATIONS

U.S. Pat. 3,078,298, Chem. Abst., vol. 58, (1963), 1493d.

*Primary Examiner*—Catherine L. Mills
*Attorney, Agent, or Firm*—Oblon, Fisher, Spivak, McClelland & Maier

[57] ABSTRACT

A germicidal herbicide for agricultural and horticultural purposes, which comprises at least one compound as an active ingredient, of the formula (I):

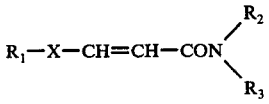

(I)

wherein $R_1$ represents an alkyl or alkenyl group having 1 to 20 carbon atoms, X represents S, SO or $SO_2$, and $R_2$ and $R_3$ which may be the same or different representing hydrogen, an alkyl group having 1 to 20 carbon atoms, an oxyalkylene group having 1 to 20 units of ethylene oxide or propylene oxide, 2-sulfoethyl or a salt thereof, or 2-carboxyethyl group.

6 Claims, No Drawings

GERMICIDAL HERBICIDE FOR AGRICULTURE AND HORTICULTURE

BACKGROUND OF THE INVENTION

1. Field of the Invention

The present invention relates to a novel germicidal herbicide for agricultural and horticultural purposes. More particularly, the invention relates to a germicidal herbicide for agricultural and horticultural purposes containing at least one compound of the formula (I);

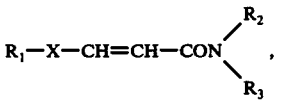

wherein $R_1$ represents an alkyl or alkenyl group haivng 1 to 20 carbon atoms, X represnts S, SO or $SO_2$, and $R_2$ and $R_3$ which may be the same or different represent hydrogen, an alkyl group having 1 to 20 carbon atoms, oxyalkylene groups having 1 to 20 units of ethylene oxide or propylene oxide, 2-sulfoethyl or a salt thereof, or a 2-carboxyethyl group, as the active ingredients.

2. Description of the Prior Art

Recently, considerable progress has been made in the development of agricultural chemicals and a number of germicides and herbicides have been formulated. However, some of these agricultural chemicals are harmful to human beings as well as animals and pollute the natural environment. Moreover, some of these chemicals are not very stable, which is often the cause of many environmental problems.

In view of the problems of many such chemicals, germicidal herbicides for agricultural and horticultural purposes have been desired which have highly stable characteristics and are very safe.

In order to eliminate the various defects which many existing germicides and herbicides possess, a number of compounds have been examined. As a result of the investigation, it has been found that alkylsulfenyl acrylic acid, alkylsulfinyl acrylic acid and alkylsulfonyl acrylic acid derivatives of the compound of formula (I) exhibit excellent germicidal effects on plant viruses and exhibit herbicidal effects on various weeds.

SUMMARY OF THE INVENTION

Accordingly, one object of the present invention is to provide a novel germicidal herbicide for agricultural and horticultural purposes characterized by improved germicidal and herbicidal effects.

DETAILED DESCRIPTION OF THE PREFERRED EMBODIMENTS

When the compounds according to the present invention are used as a germicide, they are capable of exterminating a wide variety of plant diseases, while possessing low phytotoxicity. On the other hand, when the compounds are used as a herbicide, they exhibit prolonged herbicidal effects as well as a stable potency under various conditions such as the different types of soils to be applied. Moreover, the compounds are of substantially reduced toxicity to man, animals and fish.

The present compounds possess excellent spreadability characteristics, wetting ability and dispersability properties in plant bodies because of their surface-active properties. Therefore, the present compounds may be used without any particular adjuvants.

The following compounds are specific compounds within the scope of the present invention. However, the scope of the invention is by no means limited to these compounds.

1 β-alkylsulfenyl acrylic acid amides

| | | | |
|---|---|---|---|
| $n\text{-}C_{12}H_{25}S{-}CH{=}CHCONH_2$ | ($n_D^{20}$ 1.5282) | $n\text{-}C_4H_9{=}S{-}CH{=}CH{-}CONH_2$ | ($n_D^{20}$ 1.4231) |
| $sec\text{-}C_4H_9{-}S{-}CH{=}CH{-}CONH_2$, | $n\text{-}C_8H_{17}{-}S{-}CH{=}CH{-}CONH_2$, | $n\text{-}C_{16}H_{33}{-}S{-}CH{=}CH{-}CONH_2$ | |

2 β-alkylsulfinyl acrylic acid amides

| | | | |
|---|---|---|---|
| $n\text{-}C_{12}H_{25}SOCH{=}CHCONH_2$ | ($n_D^{20}$ 1.5163) | $n\text{-}C_4H_9{-}SO{-}CH{=}CH{-}CONH_2$ | ($n_D^{20}$ 1.4362) |

3 β-alkylsulfonyl acrylic acid amides

| | | | |
|---|---|---|---|
| $n\text{-}C_{12}H_{25}SO_2CH{=}CHCONH_2$ | (m p 58~59° C) | $n\text{-}C_4H_9{-}SO_2{-}CH{=}CH{-}CONH_2$ | (m p 52~53° C) |

4 β-alkylsulfenyl acrylic acid alkylamids

| | | | |
|---|---|---|---|
| $n\text{-}C_{12}H_{25}SCH{=}CHCON(CH_3)_2$ | ($n_D^{20}$ 1.5362) | $n\text{-}C_4H_9{-}S{-}CH{=}CH{-}CON(CH_3)_2$ | ($n_D^{20}$ 1.4462) |
| $n\text{-}C_4H_9{-}S{-}CH{=}CH{-}CON(n\text{-}CH_2CH_2CH_3)H$ | $n\text{-}C_4H_9{-}CH{=}CH{-}CONHCH_3$ | $n\text{-}C_8H_{17}{-}S{-}CH{=}CH{-}CPNHCH_3$ | |
| $n\text{-}C_8H_{17}{-}S{-}CH{=}CH{-}CON(n\text{-}CH_2CH_2CH_3)H$ | $n\text{-}C_8H_{17}{-}S{-}CH{=}CH{-}CON(CH_3)_2$ | $n\text{-}C_{10}H_{21}{-}S{-}CH{-}CON(CH_3)_2$ | |
| $n\text{-}C_{12}H_{25}{-}S{-}CH{=}CH{-}CONHCH_3$ | $n\text{-}C_{12}H_{25}{-}S{-}CH{=}CH{-}CON(n\text{-}CH_2CH_2CH_3)H$ | | |
| $n\text{-}C_{14}H_{29}{-}S{-}CH{=}CH{-}CON(C_{12}H_5)(C_2H_5)$ | $n\text{-}C_{18}H_{37}{-}S{-}CH{=}CH{-}CONHCH_3$ | | |

5 β-alkylsulfinyl acrylic acid alkylamides

| | | | |
|---|---|---|---|
| $n\text{-}C_{12}H_{25}SOCH{=}CHCON(CH_3)_2$ | ($n_D^{20}$ 1.5263) | $n\text{-}C_4H_9{-}SO{-}CH{=}CH{-}CON(CH_3)_2$ | ($n_D^{20}$ 1.5032) |
| $n\text{-}C_4H_9{-}SO{-}CH{=}CH{-}CONHCH_3$ | $n\text{-}C_4H_9{-}SO{-}CH{=}CH{-}CONH{-}CH_2CH_2CH_3$ | $iso\text{-}C_4H_9{-}SO{-}CH{=}CH{-}CON(n\text{-}CH_2CH_2CH_3)H$ | |
| $n\text{-}C_8H_{17}{-}SO{-}CH{=}CH{-}CON(n\text{-}CH_2CH_2CH_3)H$ | $n\text{-}C_8H_{17}{-}SO{-}CH{=}CH{-}CONHCH_3$ | $n\text{-}C_{12}H_{25}{-}SO{-}CH{-}CH{-}CONHCH_3$ | |
| $n\text{-}C_{12}H_{25}{-}SO{-}CH{=}CH{-}CON(n\text{-}CH_2CH_2CH_3)H$ | $n\text{-}C_{18}H_{37}{-}SO{-}CH{=}CH{-}CONHCH_3$ | | |

6 β-alkylsulfonyl acrylic acid alkylamides

| | | | |
|---|---|---|---|
| $n\text{-}C_{12}H_{25}SO_2CH{=}CHCON(CH_3)_2$ | (m p 63~64° C) | $n\text{-}C_4H_9{-}SO_2{-}CH{=}CH{-}CON(CH_3)_2$ | (m p 48~49° C) |

$n\text{-}C_4H_9-SO_2-CH=CH-CONHCH_3$ $n\text{-}C_{12}H_{25}-SO_2-CH=CH-CONHCH_3$ 7 β-alkylsulfenyl di-(2-hydroxyethyl)amides $n\text{-}C_{12}H_{25}SCH=CHCON(CH_2CH_2OH)_2$ ($n_D^{20}$ 1.5321)

8 β-alkylsulfinyl di-(2-hydroxyethyl) amides $n\text{-}C_{12}H_{25}SOCH=CHCON(CH_2CH_2OH)_2$ ($n_D^{20}$ 1.5363)

$n\text{-}C_8H_{17}-SO-CH=CH-CON(CH_2CH_2OH)_2$

9 β-alkylsulfonyl di-(2-hydroxyethyl)amides $n\text{-}C_{12}H_{25}SO_2CH=CHCON(CH_2CH_2OH)_2$ (m p 48~49° C)

$-C_{10}H_{21}-SO_2-CH=CH-CON(CH_2CH_2OH)_2$

10 β-alkylsulfenyl-2-sulfoethylamides $n\text{-}C_{12}H_{25}SCH=CHCONHCH_2CH_2SO_3Na$ (m p 90~91° C)

$n\text{-}C_{10}H_{21}-S-CH=CH-CONHCH_2CH_2SO_3NO$

11 β-alkylsulfinyl-2-sulfoethylamides $n\text{-}C_{12}H_{25}SOCH=CHCONHCH_2CH_2SO_3Na$ (m p 93~94° C)

12 β-alkylsulfonyl-2-sulfoethylamides $n\text{-}C_{12}H_{25}SO_2CH=CHCONHCH_2CH_2SO_3Na$ (m p 120~121° C)

13 β-alkylsulfenyl-2-carboxyethylamides $n\text{-}C_{12}H_{25}SCH=CHCONHCH_2CH_2COONa$ (m p 64~65° C)

14 β-alkylsulfinyl-2-carboxyethylamides $n\text{-}C_{12}H_{25}SOCH=CHCONHCH_2CH_2COONa$ (m p 52~53° C)

15 β-alkylsulfonyl-2-carboxyethylamides $n\text{-}C_{12}H_{25}SO_2CH=CHCONHCH_2CH_2COONa$ (m p 92~91° C)

16 β-alkylsulfenyl di-(polyoxyalkylene)amides $n\text{-}C_4H_9-S-CH=CH-CON((CH_2O)nH)((CH_2CH_2O)n'H)$ (n + n' = 20)

$n\text{-}C_8H_{17}-S-CH=CH-CON((CH_2CH_2O)nH)((CH_2CH_2O)n'H)$ (n + n' = 4)

17 β-alkylsulfinyl di-(polyoxyalkylene)amides $n\text{-}C_4H_9-SO-CH=CH-CON((CH_2CH_2O)nH)((CH_2CH_2O)n'H)$ (n + n' = 20)

-continued $n\text{-}C_8H_{17}-SO_2-CH=CH-CON(n\text{-}CH_2CH_2CH_3)(H)$ $n\text{-}C_{18}H_{37}-SO_2-CH=CH-CONHCH_3$ $n\text{-}C_4H_9-S-CH=CH-CON((PO)nH)((PO)n'H)$ (PO: oxypropylene unit, n + n' = 20)

$n\text{-}C_{16}H_{33}-S-CH=CH-CON((PO)nH)((PO)n'H)$ (PO: oxypropylene unit, n + n' = 15)

$n\text{-}C_4H_9-SO-CH=CH-CON((PO)nH)((PO)n'H)$ (PO: oxypropylene unit)

$n\text{-}C_8H_{17}-SO_2-CH=CH-CONHCH_3$ $n\text{-}C_4H_9-S-CH=CH-CON(CH_2CH_2OH)_2$ ($n_D^{20}$ 1.4892)

$n\text{-}C_4H_9-SO-CH=CH-CON(CH_2CH_2OH)_2$ ($n_D^{20}$ 1.5032)

$n\text{-}C_4H_9-SO_2-CH=CH-CON(CH_2CH_2OH)_2$ ($n_D^{20}$ 1.5121)

$n\text{-}C_4H_9-S-CH=CH-CONHCH_2CH_2SO_3Na$ (m p 45~46° C)

$n\text{-}C_4H_9-SO-CH=CH-CONHCH_2CH_2SO_3Na$ (m p 90~91° C)

$n\text{-}C_4H_9-SO_2-CH=CH-CONHCH_2CH_2SO_3Na$ (m p 115~116° C)

$n\text{-}C_4H_9-S-CH=CH-CONHCH_2CH_2COONa$ (m p 60~61° C)

$n\text{-}C_4H_9-SO-CH=CH-CONHCH_2CH_2COONa$ (m p 48~49° C)

$n\text{-}C_4H_9-SO_2-CH=CH-CONHCH_2CH_2COONa$ (m p 88~89° C)

Compounds of the formula (I) of the present invention can be prepared by any convenient technique, one of which is as follows: Thus a mercaptan of the formula (II);

$$R_1 - SH \quad (II)$$

wherein $R_1$ is the same as defined above can be reacted with an acetylene monocarboxylic acid in an aqueous solution of an alkali metal hydroxide to produce a $\beta$-sulfenyl acrylic acid of the formula (III), $$R_1 - S - CH = CH - COOM \quad (III)$$

wherein M represents hydrogen or an alkali metal and $R_1$ is the same as defined above. Thereafter, the resulting $\beta$-sulfenyl acrylic acid or halide thereof is reacted with an amine represented by formula (IV);

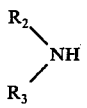

(IV)

wherein $R_2$ and $R_3$ are the same as defined above, thereby yielding a compound wherein X in the formula (I) is S. Compound thus obtained is oxidized with an inorganic peroxide such as sodium metaperiodate or hydrogen peroxide, or an organic peroxide such as m-chloroperbenzoic acid, perbenzoic acid or peracetic acid whereby a compound is obtained wherein X in the formula (I) is in the oxidized form of SO or $SO_2$ (Japanese Patent Applications Nos. 82372/1975, 84944/1975 and 84945/1975).

Compounds of formula (I) may be used alone as a germicide for agricultural and horticultural purpose without any other adjuvants. However, the compounds can be used in the form of a wettable powder solution or in any other form by which agricultural chemicals can generally be applied such as a solution or suspension of the chemical in a conventional carrier or by mixing the chemical with an adjuvant.

The compounds of formula (I) may be used as a germicide in a concentration ranging from 300 to 1000 ppm, preferably 500 ppm.

The present compounds have the ability to exterminate plant diseases by applying the chemicals to the plant body or plant undergrowth by spreading the chemical or spraying a solution of the chemical.

The present compounds can also be used as an antiseptic by immersing seeds or bulbs in liquids containing the chemical.

The compounds of formula (I) of the present invention possess a particularly strong herbicidal action on gramineae weeds such as barnyardgrass, *Cyperus microiria,* henry crabgrass, goosegrass and reen foxtail; broad-leaved weeds such as *Polygonum blumei,* livid amaranth, common purslane and common lambsquarters; and perennial weeds such as purple nutsedge, *Rumex japonicus* and pink woodsorrel all of which grow in fields. Moreover, the herbicidal effects of the present compounds are particularly strong on gramineae weeds such as barnyardgrass; broad-leaved weeds such as *Monochloria vaginalis, Rotala indica* and *Dopatrium junceum;* and perennial weeds such as slender spikerush, *Scirpus hotarui, Sagittaria pygmaea, Cyperus serotinus* and *Eleocharis kuroguwai* all of which grow in paddy fields.

The present compounds can be used alone in a field or paddy field and also in the conventional forms of a powder, granules, hydrates, emulsions and the like by dissolving, suspending or emulsifying the compounds in carriers or by mixing the compounds with an adjuvant. The compounds of formula (I) may be normally employed in a concentration ranging from 3000 to 6000 ppm, preferably 4000 ppm.

Suitable solid carriers which are useful as an adjuvant include mineral powders of clays such as kaolin, bentonite and terra abla; talcs, such as talcum powder; silicates such as diatomaceous earth, vermiculite, slaked lime and mica powder; and alumina, silica gel and the like. Suitable liquid carriers which are useful include alcohols, ketones, benzene, xylene, toluene and cyclohexane.

Because the compounds of formula (I) possess a surface-active potency by themselves, other common surface-active agents do not necessarily have to be combined with the compounds. However, surface-active agents known as spreaders, emulsifiers, penetrants, dispersants and solubilizers may be used in combination with the compounds. Also soaps such as higher alcohol sulfates, alkyl sulfonates, alkylaryl sulfonates, quaternary ammonium salts, polyalkylene oxides, higher fatty acid esters and the like can also be used.

The germicidal herbicides of the present invention for agricultural and horticultural use may be used, if necessary, in combination with other herbicides, insecticides, fertilizer components, soil-improving agents or germicides.

Having generally described this invention, a further understanding can be obtained by reference to certain specific examples which are provided herein for purposes of illustration only and are not intended to be limiting unless otherwise specified.

EXAMPLE 1

(Wettable Hydrate)

A mixture of 50 parts by weight of n-$C_{12}H_{25}SCH{=}CHCONH{-}CH_2CH_2CH_3$, 5 parts by weight of a surface-active agent (an alkylbenzene sulfonate and a higher alcohol sulfate) and 45 parts by weight of clay was fully crushed whereby a wettable powder containing 50% of the amide compound of the present invention as the main component was obtained. When the mixture was ready for use, it was diluted 1000 times with water.

EXAMPLE 2

(Emulsion)

10 parts by weight of n-$C_{12}H_{25}SCH{=}CHCONH{-}CH_2CH_2CH_3$, 10 parts by weight of acetone, 20 parts by weight of an emulsifier (higher fatty acid esters) and 60 parts by weight of water were mixed whereby an emulsifiable concentrate containing 10% of the present compound as the main component was obtained. When the mixture was ready for use, it was diluted 200 times with water.

EXAMPLE 3

(Extermination effect on *Helminthosporium oryzae*)

In a series of plastic pots each 16 cm in length, 10 cm in width and 5 cm in height were bred 20 stubbles of rice plants in a greenhouse. At the four leaf stage of plant growth, 20 ml of an emulsion or wettable powder suspension containing 500 ppm of each of the test compounds was sprayed over the plant bodies. After spraying, the plants were allowed to stand in the greenhouse. Then spores of *Helminthosporium oryzae* cultured in a test tube were suspended in water. The rice plants were inoculated with the spores by spraying the spore containing solution evenly over the plants. The plants were allowed to grow at a constant temperature of 37° C. and a relative humidity of more than 95%. On the fifth day after infection, the number of spore infected spots per leaf was counted. The fungicidal activity of the applied active ingredient was calculated from a comparison of the number of spots on leaves untreated with the active ingredient. The results obtained are shown in Table 1.

Table 1

| Test compounds | Concentration of active ingredients (ppm) | Fungicidal activity (%) | Phytotoxic effect |
|---|---|---|---|
| $n\text{-}C_8H_{17}SCH{=}CHCONH_2$ | 500 | 73 | — |
| $n\text{-}C_8H_7SCH{=}CHCON(CH_3)(CH_3)$ | 500 | 82 | — |
| $n\text{-}C_8H_{17}SOCH{=}CHCON(n\text{-}CH_2CH_2CH_3)(H)$ | 500 | 76 | — |
| $n\text{-}C_{10}H_{21}SCH{=}CHCON(CH_3)(CH_3)$ | 500 | 90 | — |
| $n\text{-}C_{10}H_{21}SO_2CH{=}CHCON(CH_2CH_2OH)_2$ | 500 | 81 | — |
| $n\text{-}C_{12}H_{25}SCH{=}CHCON(CH_3)(CH_3)$ | 500 | 88 | — |
| $n\text{-}C_{12}H_{25}SCH{=}CHCON(n\text{-}CH_2CH_2CH_3)(H)$ | 500 | 95 | — |
| $n\text{-}C_{12}H_{25}SOCH{=}CHCONHCH_2CH_2SO_3Na$ | 500 | 91 | — |
| $n\text{-}C_{12}H_{25}SO_2CH{=}CHCON(CH_3)(CH_3)$ | 500 | 92 | — |
| $n\text{-}C_{12}H_{25}SCH{=}CHCONHCH_2CH_2COONa$ | 500 | 87 | — |
| Commercial fungicide *(1500 times dilution) | — | 69 | ± |
| Control | — | 0 | — |

*It contains 30 parts by weight of O-ethyl-S,S-diphenyl-dithiophosphate.
— no harm,
± slight harm

EXAMPLE 4

(Extermination effect on *Colletotrichum lagenarium*)

Cucumbers (Var., Su-yo) were placed in pots. 20 ml of each of the test compounds shown in Table 2 in the concentration shown were sprayed over the pots. The next day a spore suspension of *colletotrichum lagenarium* was applied to the plants in an inoculation box at 27° C. at a humidity of more then 95% with a microsprayer. Two days later the boxes were transferred to a hothouse and 7 days later, the infected spots on the surface of the leaves were investigated, and the fungicidal activity of the applied spray was calculated. The results obtained are shown in Table 2.

Table 2

| Test compounds | Concentration of active ingredients (ppm) | Fungicidal activity (%) | Phytotoxic effect |
|---|---|---|---|
| $n\text{-}C_4H_9SCH{=}CHCON(CH_3)(CH_3)$ | 500 | 75 | — |
| $n\text{-}C_8H_{17}SCH{=}CHCON(n\text{-}CH_2CH_2CH_3)(H)$ | 500 | 82 | — |
| $n\text{-}C_8H_{17}SOCH{=}CHCON(n\text{-}CH_2CH_2CH_3)(H)$ | 500 | 80 | — |
| $n\text{-}C_8H_{17}SO_2CH{=}CHCON(n\text{-}CH_2CH_2CH_3)(H)$ | 500 | 85 | — |
| $n\text{-}C_8H_{17}SOCH{=}CHCON(CH_2CH_2OH)_2$ | 500 | 79 | — |

Table 2-continued

| Test compounds | Concentration of active ingredients (ppm) | Fungicidal activity (%) | Phytotoxic effect |
|---|---|---|---|
| $n\text{-}C_{10}H_{21}SCH{=}CHCON\begin{matrix}CH_3\\CH_3\end{matrix}$ | 500 | 92 | — |
| $n\text{-}C_{10}H_{21}SCH{=}CHCONHCH_2CH_2SO_3Na$ | 500 | 87 | — |
| $n\text{-}C_{12}H_{25}SCH{=}CHCONH_2$ | 500 | 1000 | — |
| $n\text{-}C_{12}H_{25}SCH{=}CHCON\begin{matrix}n\text{-}CH_2CH_2CH_3\\H\end{matrix}$ | 500 | 100 | — |
| $n\text{-}C_{12}H_{25}SOCH{=}CHCON\begin{matrix}n\text{-}CH_2CH_2CH_3\\H\end{matrix}$ | 500 | 98 | — |
| $n\text{-}C_{14}H_{29}SCH{=}CHCON\begin{matrix}C_2H_5\\C_2H_2\end{matrix}$ | 500 | 89 | — |
| $n\text{-}C_{16}H_{35}SCH{=}CHCONH_2$ | 500 | 91 | — |
| $n\text{-}C_{16}H_{33}SOCH{=}CHCON\begin{matrix}(PO)_nH\\(PO)_nH\end{matrix}$ | 500 | 88 | — |
| (PO: oxypropylene units n + n' = 15) | | | |
| Commercial fungicide* (1500 times dilution) | — | 93 | — |
| Control | — | | — |

*It contains 70 parts by weight of 1,2-bis (3-methoxycarbonyl-2-thioureide) benzene as an active ingredient.
— no harm

EXAMPLE 5

(Extermination effect on *Erwinia aroideae*)

Slices (length 3 cm, width 2 cm) of the white stempart of commercial celery cabbages were obtained and immersed into emulsions each containing 500 ppm of a test compound of the present invention. Thereafter, the slices were air-dried, and were inoculated with a spore suspension of *Erwinia aroideae* with five needle bundles. The slices were allowed to stand in an inoculation box at 27° C. a humidity and more than 95% for one day. The number of infected spots was measured and the fungicidal activity of the active compound was calculated. The results obtained are shown in Table 3.

Table 3

| Test compounds | Concentration of avtive ingredients (ppm) | (%) Fungicidal activity | Phytotoxic effect |
|---|---|---|---|
| $n\text{-}C_4H_9SCH{=}CHCONH_2$ | 500 | 72 | — |
| $n\text{-}C_4H_9SCH{=}CHCON\begin{matrix}n\text{-}CH_2CH_2CH_3\\H\end{matrix}$ | 500 | 93 | — |
| $iso\text{-}C_4H_9SOCH{=}CHCON\begin{matrix}n\text{-}CH_2CH_2CH_3\\H\end{matrix}$ | 500 | 82 | — |
| $sec\text{-}C_4H_9SCH{=}CHCONH_2$ | 500 | 89 | — |
| Commercial fungicide * (1000 times dilution) | — | 32 | — |
| Control | — | | — |

* It contains 12.5 parts by weight of dihydrostreptomycin sulfate.
— no harm

EXAMPLE 6

A mixture of 25 parts by weight of $n\text{-}C_4H_9SOCH{=}CHCONH{-}CH_2CH_2CH_3$, 5 parts by weight of diisobutylene-disodium maleate copolymer powder and 70 parts by weight of clay was fully crushed whereby a wettable powder was obtained.

EXAMPLE 7

40 parts by weight of $n{-}C_4H_9SOCH{=}CHCONHCH_2CH_2CH_3$, 20 parts by weight of polyoxyethylene (20) sorbitan monooleate and 40 parts by weight of cyclohexane were fully mixed to yield an emulsifiable concentrate.

EXAMPLE 8

A mixture of 10 parts by weight of $n{-}C_4H_9SOCH{=}CHCONH{-}CH_2CH_2CH_3$, 30 parts by weight of bentonite, 50 parts by weight of clay, 6 parts by weight of palm alcohol sulfate sodium powder and 4 parts by weight of Demol EP powder (made by Kao Soap Co., Ltd.) was fully crushed. To to this mixture was added water, and the resulting mixture was kneaded and dried to yield granular composition.

EXAMPLE 9

In plastic pots each 15 cm in length, 10 cm in width and 8 cm in height were placed field soil. Each of the pots was planted with 20 grains of seeds of weeds and with 20 grains of the seeds of a crop.

On the second and seventh days after the seeds were covered with the soil in the pots, a test compound (15 ml of solution/pot: corresponding to 500 g of active ingredient per 10 are) were sprayed on the whole surface of the plants. On the 14th day after spraying, the inhibitory effect on weed-growth and the possible harmful effect of the active compound on the crops were investigated. The results obtained are shown in Table 4.

Table 4

| Test compounds | Inhibitory effect on weed-growth | | | | | | | Harmful effect on crops | | | |
|---|---|---|---|---|---|---|---|---|---|---|---|
| | henry grass | green foxtail | livid amaranth | Polygonum blumei | Common lambsquarters | Common purslane | Rumex japonicus | corn | red bean | soybean | peanut |
| 1 $n\text{-}C_4H_9SCH{=}CHCONH_2$ | 5 | 5 | 5 | 5 | 5 | 5 | 5 | 0 | 0 | 0 | 0 |
| 2 $n\text{-}C_4H_9SCH{=}CHCONH{-}CH_3$ | 5 | 5 | 5 | 5 | 5 | 5 | 5 | 0 | 0 | 0 | 0 |
| 3 $n\text{-}C_3H_9SCH{=}CHCON(CH_3)_2$ | 5 | 5 | 5 | 5 | 5 | 5 | 5 | 0 | 0 | 0 | 0 |
| 4 $n\text{-}C_4H_9SCH{=}CHCON(CH_2CH_2OH)_2$ | 5 | 5 | 4.5 | 4 | 4 | 4 | 4 | 0 | 0 | 0 | 0 |
| 5 $n\text{-}C_4H_9SCH{=}CHCON\begin{cases}(PO)_nH\\(PO)_{n'}H\end{cases}$ | 5 | 4 | 4 | 4 | 4 | 4 | 3 | 0 | 0 | 0 | 0 |
| (PO : Oxypropylene unit, n + n' = 20) | | | | | | | | | | | |
| 6 $n\text{-}C_4H_9SCH{=}CHCONH{-}CH_2CH_2SO_3Na$ | 5 | 5 | 5 | 4.5 | 4.5 | 4.5 | 4.5 | 0 | 0 | 0 | 0 |
| 7 $n\text{-}C_4H_9SCH{=}CHCON\begin{cases}(CH_2CH_2O)_nH\\(CH_2CH_2O)_{n'}H\end{cases}$ | 5 | 5 | 5 | 4.5 | 4.5 | 4 | 4 | 0 | 0 | 0 | 0 |
| (n + n' = 20) | | | | | | | | | | | |
| 8 $n\text{-}C_4H_9SOCH{=}CHCONH_2$ | 5 | 5 | 5 | 5 | 5 | 5 | 5 | 0 | 0 | 0 | 0 |
| 9 $n\text{-}C_4H_9SOCH{=}CHCONH{-}CH_3$ | 5 | 5 | 5 | 5 | 5 | 5 | 5 | 0 | 0 | 0 | 0 |
| 10 $n\text{-}C_4H_9SOCH{=}CHCON(CH_3)_2$ | 5 | 5 | 5 | 5 | 5 | 5 | 5 | 0 | 0 | 0 | 0 |
| 11 $n\text{-}C_4H_9SOCH{=}CHCONH{-}CH_2CH_2CH_3$ | 5 | 5 | 5 | 5 | 5 | 5 | 5 | 0 | 0 | 0 | 0 |
| 12 $n\text{-}C_4H_9SOCH{=}CHCON(CH_2CH_2OH)_2$ | 5 | 5 | 5 | 4.5 | 4.5 | 4.5 | 4.5 | 0 | 0 | 0 | 0 |
| 13 $n\text{-}C_4H_9SOCH{=}CHCON\begin{cases}(CH_2CH_2O)_nH\\(CH_2CH_2O)_{n'}H\end{cases}$ | 5 | 5 | 4 | 4 | 4 | 3 | 3 | 0 | 0 | 0 | 0 |
| (n + n' = 20) | | | | | | | | | | | |
| 14 $n\text{-}C_4H_9SOCH{=}CHCONH{-}CH_2CH_2SO_3Na$ | 5 | 5 | 5 | 5 | 5 | 5 | 4.5 | 0 | 0 | 0 | 0 |
| 15 $n\text{-}C_4H_9SOCH{=}CHCON\begin{cases}(PO)_nH\\(PO)_{n'}H\end{cases}$ | 5 | 5 | 4 | 4 | 4 | 4 | 4 | 0 | 0 | 0 | 0 |
| (PO : | | | | | | | | | | | |
| 16 $n\text{-}C_4H_9SO_2CH{=}CHCONH_2$ | 5 | 5 | 5 | 5 | 5 | 5 | 5 | 0 | 0 | 0 | 0 |
| 17 $n\text{-}C_4H_9SO_2CH{=}CHCONH{-}CH_3$ | 5 | 5 | 5 | 5 | 5 | 5 | 5 | 0 | 0 | 0 | 0 |
| 18 $n\text{-}C_4H_9SO_2CH{=}CHCON(CH_3)_2$ | 5 | 5 | 5 | 5 | 5 | 5 | 5 | 0 | 0 | 0 | 0 |
| 19 $n\text{-}C_4H_9SO_2CH{=}CHCON(CH_2CH_2OH)_2$ | 5 | 5 | 4 | 4 | 4 | 4 | 4 | 0 | 0 | 0 | 0 |
| 20 $n\text{-}C_4H_9SO_2CH{=}CHCONH{-}CH_2CH_2SO_3Na$ | 5 | 5 | 5 | 4.5 | 4.5 | 4.5 | 4 | 0 | 0 | 0 | 0 |
| 21 $n\text{-}C_4H_9SO_2CH{=}CHCONH{-}CH_2CH_2COONa$ | 5 | 5 | 5 | 5 | 4.5 | 4.5 | 4.5 | 0 | 0 | 0 | 0 |
| 22 $n\text{-}C_8H_{17}SCH{=}CHCONH{-}CH_3$ | 4 | 4 | 4 | 4 | 4 | 4 | 4 | 0 | 0 | 0 | 0 |
| 23 $n\text{-}C_8H_{17}SCH{=}CHCON\begin{cases}(CH_2CH_2O)_nH\\(CH_2CH_2O)_{n'}H\end{cases}$ | 4 | 4 | 4 | 4 | 4 | 4 | 3 | 0 | 0 | 0 | 0 |
| (n + n' = 4) | | | | | | | | | | | |
| 24 $n\text{-}C_8H_{17}SOCH{=}CHCONH{-}CH_3$ | 4 | 4 | 4 | 4 | 4 | 4 | 3 | 0 | 0 | 0 | 0 |
| 25 $n\text{-}C_8H_{17}SO_2CH{=}CHCONH{-}CH_3$ | 4 | 4 | 4 | 4 | 4 | 3 | 3 | 0 | 0 | 0 | 0 |
| 26 $n\text{-}C_{12}H_{25}SCH{=}CHCONH{-}CH_3$ | 4 | 4 | 4 | 4 | 4 | 4 | 4 | 0 | 0 | 0 | 0 |
| 27 $n\text{-}C_{12}H_{25}SOCH{=}CHCONH{-}CH_3$ | 4 | 4 | 4 | 4 | 4 | 4 | 4 | 0 | 0 | 0 | 0 |
| 28 $n\text{-}C_{12}H_{25}SO_2CH{=}CHCONH{-}CH_3$ | 4 | 4 | 4 | 4 | 4 | 4 | 4 | 0 | 0 | 0 | 0 |
| 29 $n\text{-}C_{18}H_{37}SCH{=}CHCONH{-}CH_3$ | 3 | 3 | 2 | 2 | 2 | 2 | 1 | 0 | 0 | 0 | 0 |
| 30 $n\text{-}C_{18}H_{37}SOCH{=}CHCONH{-}CH_3$ | 3 | 3 | 2 | 2 | 2 | 2 | 1 | 0 | 0 | 0 | 0 |
| 31 $n\text{-}C_{18}H_{37}SO_2CH{=}CHCONH{-}CH_3$ | 3 | 3 | 2 | 2 | 2 | 2 | 1 | 0 | 0 | 0 | 0 |
| 32 Trisluralin emulsion | 5 | 5 | 5 | 4.5 | 5 | 5 | 2 | 3 | 4 | 2 | 1 |

The Definition of the Numerical Rating Systems in Table 4

Inhibitory effect on weed-growth 5 perfect inhibition
4 80% inhibition
3 60% inhibition
2 40% inhibition
1 20% inhibition
0 no effect Harmful effect on crops 4 withering
3 severe harm
2 moderate harm
1 slight harm
0 no effect

EXAMPLE 10

In a 1/5000 Wagner's pot was placed a soil sample containing uniformly distributed subterranean stems of slender spikerush, *Sagittaria pygmaea* and *Sciprus hotarui* and into which were planted 40 grains of barnyard grass, *Monochloria vaginalis, Rotala indica* and *Dopatrium junceum.* Six paddies of the two leaf stage of growth of rice plants were planted in each pot and the pot was filled with water to a depth of 3 cm of water over the soil surface. 500g of each of the test compounds employed in the tests per 10 are were sprayed on the plants and on the 14th day the inhibitory effect on weed-growth and the phytotoxic effect of the compounds on crops were investigated. The results obtained are shown in Table 5. The basis for grading the inhibitory effect of the present compounds on weed-growth in Table 5 is the same as presented in Table 4.

Table 5

| Test compounds | Inhibitory effect on weed-growth | | | | | | Phytotoxic effect |
|---|---|---|---|---|---|---|---|
| | barnyard grass | monochoria vaginalis | Rotala indica | slender spikerush | sagittaria pygmaea | sciprus hotarui | |
| Compound 1 | 5 | 5 | 5 | 5 | 5 | 5 | |
| " 2 | 5 | 5 | 5 | 5 | 5 | 5 | " |
| " 3 | 5 | 5 | 5 | 5 | 5 | 5 | " |
| " 4 | 5 | 4.5 | 4.5 | 4 | 4 | 4 | " |
| " 5 | 4 | 3 | 3 | 3 | 2 | 2 | " |
| " 6 | 5 | 5 | 5 | 5 | 5 | 5 | " |
| " 8 | 5 | 5 | 5 | 5 | 5 | 5 | " |
| " 9 | 5 | 5 | 5 | 5 | 5 | 5 | " |
| " 10 | 5 | 5 | 5 | 5 | 4 | 4 | " |
| " 12 | 5 | 5 | 5 | 4.5 | 4.5 | 4 | " |
| " 13 | 4 | 3 | 3 | 3 | 2 | 2 | " |
| " 14 | 5 | 5 | 5 | 5 | 5 | 5 | " |
| " 15 | 4 | 3 | 3 | 3 | 2 | 2 | " |
| " 16 | 5 | 5 | 5 | 5 | 5 | 5 | " |
| " 17 | 5 | 5 | 5 | 5 | 5 | 5 | " |
| " 18 | 5 | 5 | 5 | 4 | 4 | 4 | " |
| " 19 | 5 | 4.5 | 4.5 | 4.5 | 4 | 4 | " |
| " 20 | 5 | 5 | 5 | 5 | 5 | 5 | " |
| " 21 | 5 | 5 | 5 | 5 | 5 | 5 | " |
| " 22 | 4 | 3 | 3 | 2 | 2 | 2 | " |
| " 23 | 4 | 3 | 3 | 2 | 2 | 2 | " |
| " 24 | 4 | 3 | 3 | 2 | 2 | 2 | " |
| " 25 | 4 | 3 | 3 | 2 | 2 | 2 | " |
| " 26 | 3 | 2 | 2 | 1 | 1 | 1 | " |
| " 27 | 3 | 2 | 2 | 1 | 1 | 1 | " |
| " 28 | 3 | 2 | 2 | 1 | 1 | 1 | " |
| " 29 | 2 | 2 | 1 | 1 | 1 | 1 | " |
| " 30 | 2 | 2 | 1 | 1 | 1 | 1 | " |
| " 31 | 2 | 2 | 1 | 1 | 1 | 1 | " |

(Note) Compounds 1 to 31 are the same as in Table 1.

What is claimed as new and intended to be secured by Letters Patent is:

1. A method of inhibiting the growth of noxious weeds which comprises applying a herbidically effective amount of at least one compound of the formula:

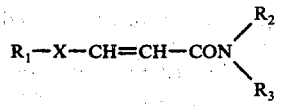

wherein $R_1$ represents an alkyl or alkenyl group having 1 to 20 carbon atoms, X represents S, SO or $SO_2$, and $R_2$ and $R_3$ which may be the same or different represent hydrogen, an alkyl group having 1 to 20 carbon atoms, an oxyalkylene group having 1 to 20 units of ethylene oxide or propylene oxide, 2-sulfoethyl or a salt thereof, or 2-carboxyethyl group to plants.

2. The method of claim 1, wherein X is S.

3. The method of claim 1, wherein X is SO.

4. The method of claim 1, wherein X is $SO_2$.

5. The method of claim 1, wherein the compound is $n—C_{12}H_{25}SCH{=}CHCONH—CH_2CH_2CH_3$.

6. The method of claim 1, wherein the compound is $n—C_4H_9SOCH{=}CHCONH—CH_2CH_2CH_3$.

* * * * *